United States Patent [19]

Hill, Jr.

[11] 4,351,491

[45] Sep. 28, 1982

[54] YARN PACKAGE SUPPORT TUBE

[75] Inventor: Broadus E. Hill, Jr., Wilmington, N.C.

[73] Assignee: E. I. Du Pont de Nemours and Company, Wilmington, Del.

[21] Appl. No.: 253,824

[22] Filed: Apr. 13, 1981

[51] Int. Cl.[3] ..... B65H 75/28

[52] U.S. Cl. ..... 242/18 PW; 242/125.1

[58] Field of Search ..... 242/18 PW, 18 A, 125.1, 242/118.3, 118.31, 118.32, 18 DD, 125

[56] References Cited

U.S. PATENT DOCUMENTS

| | | | |
|---|---|---|---|
| 1,956,191 | 4/1934 | Crooks . | |
| 2,262,665 | 11/1941 | Cavanaugh | 242/125 |
| 3,103,305 | 9/1963 | Heatherly | 242/125.1 X |
| 3,276,704 | 10/1966 | Pabis | 242/18 PW |
| 3,282,516 | 11/1966 | Porter | 242/18 PW |
| 3,284,023 | 11/1966 | Sowell | 242/125.1 |
| 3,326,494 | 6/1967 | Hartley | 242/125.1 |
| 3,717,291 | 2/1973 | Adams et al. | 242/125.1 X |
| 3,967,795 | 7/1976 | Shindo et al. | 242/125.1 |
| 3,986,680 | 10/1976 | Cardell | 242/125.1 |
| 4,063,688 | 12/1977 | Grellier | 242/18 DD |
| 4,063,696 | 12/1977 | Kelly et al. | 242/125.1 |
| 4,081,149 | 3/1978 | Miller | 242/18 PW |
| 4,083,505 | 4/1978 | Burkhardt | 242/18 PW |
| 4,099,679 | 7/1978 | De Baker et al. | 242/18 PW |

FOREIGN PATENT DOCUMENTS

| | | |
|---|---|---|
| 53328 | 10/1970 | Australia . |
| 1199086 | 6/1959 | France . |
| 1324687 | 4/1963 | France . |
| 485012 | 5/1938 | United Kingdom . |
| 941195 | 11/1963 | United Kingdom . |
| 1044330 | 9/1966 | United Kingdom . |

*Primary Examiner*—Stanley N. Gilreath

[57] ABSTRACT

A yarn package support tube has a V-shaped stringup groove extending partially around its circumference and located adjacent one of its ends for initiation of a helical transfer tail. The tube is also provided with a yarn parking groove located between the stringup groove and the one end.

2 Claims, 2 Drawing Figures

YARN PACKAGE SUPPORT TUBE

BACKGROUND OF THE INVENTION

This invention relates to the winding of yarn packages and, more particularly, to the supports on which textile yarn packages are wound.

It is known in the art that a transfer tail can be included in the initial length of yarn wound on a yarn package support tube. Often the winding operation involves pickup of a running threadline end from its steady path ahead of the fanning guide into a sucker gun and stringing the threadline onto the empty core by snagging it in a snagging groove then winding a transfer tail with an automatic transfer tail winder guide. Yarn being taken up by a sucker gun will frequently, for reasons not fully understood, vibrate between the tip of the sucker gun nozzle and the next previous guide or even beyond. As the threadline is strung across the end of the empty support tube prior to activation of the automatic transfer-tail winding device, this vibration sometimes causes the threadline or some filaments thereof to run off the end of the tube and wrap around the chuck carrying the tube or be snagged in the stringup groove before actuation of the automatic transfer-tail winder. In either case, production time and product are lost while yarn is removed, a fresh empty tube is installed and stringup repeated.

SUMMARY OF THE INVENTION

A yarn support tube has a surface stringup groove extending partially around its circumference and located adjacent one of its ends for initiation of a helical transfer tail. The tube is also provided with a circumferential yarn parking groove located between said one end and the stringup groove. In the preferred embodiment the parking groove is rolled into the outside surface of the tube forming a smooth circumferential indentation.

DETAILED DESCRIPTION OF THE PREFERRED EMBODIMENT

Figure 1:
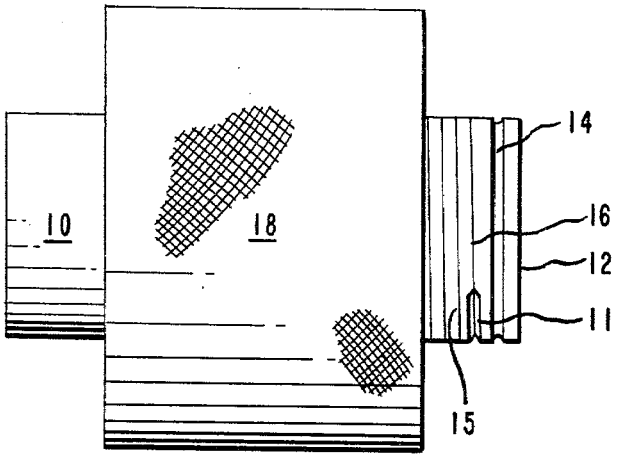
FIG. 1 is an elevational view of a yarn package wound on a preferred embodiment of the support tube.

Referring to the drawing, the preferred yarn support is a hollow cylindrical tube 10 having a partial circumferential stringup groove 11 cut into its outer surface near and in substantial parallelism with one end 12 and having a circumferential yarn parking groove 14 located between the one end 12 and the stringup groove 11. The cross section of groove 11 is substantially a narrow V-shaped configuration which permits the starting end 16 (FIG. 1) to be introduced into the groove, snagged and held as the spindle or chuck (not shown) which supports the tube 10 is rotated at the start of a package winding operation. As the yarn is wound on the tube 10 it continues as a transfer tail 15, consisting of a plurality of helical turns toward the central portion of the tube where a package 18 is wound. Transfer tail 15 should be a convenient length of yarn for tying to the outer end of another package. The number of helical turns may be made as required to provide the desired length. Yarn parking groove 14 is a smooth-surfaced indentation roller into the outside surface of the tube 10 (typically 0.015 inches deep by 1/16 inch wide). The groove provides a ditch in which the threadline 20 runs when it is placed on the tube before stringup. The groove 14 dampens vibration and stabilizes the threadline 20. This prevents premature snagging in stringup groove 11 and prevents the threadline 20 from wandering off the end of the tube.

Figure 2:
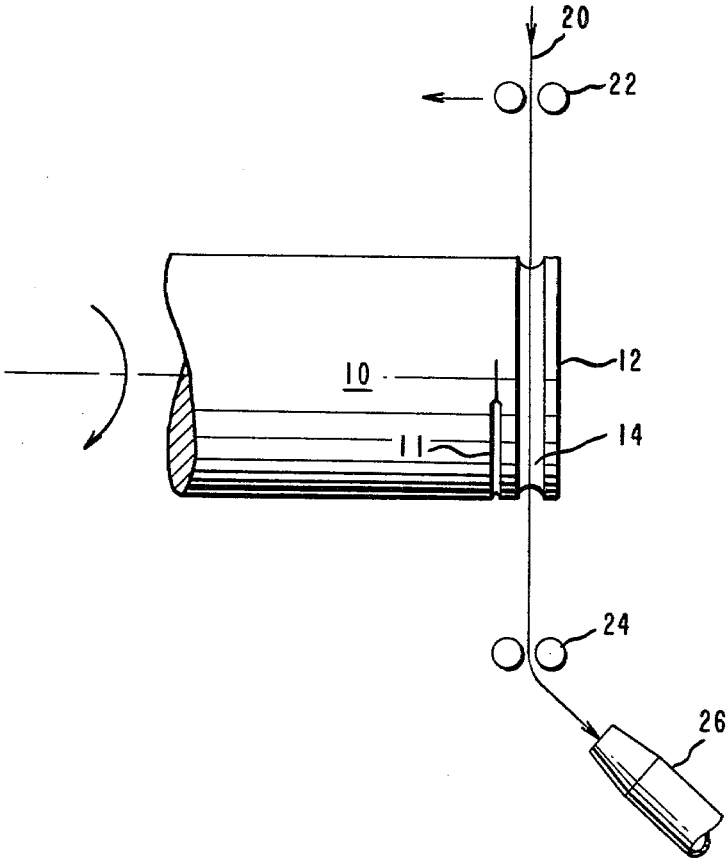
FIG. 2 is a schematic view of the initiation of a package on a driven yarn package support of the invention.

The package 18 may be wound on readily available winding equipment. For example, the tube 10 may be placed on a chuck. After bringing the chuck to the required rotational speed the threadline 20 running through transfer tail winder device 22 through guide 24 and into sucker gun 26 (FIG. 2) may be introduced into stringup groove 11 by the indicated movement of transfer tail winder device 22. After starting end 16 is snagged and broken, tail 15 is wound as the transfer winder 22 guides the yarn laterally to a position where it is picked up by a suitable traverse guide through which it advances as the package 18 is wound.

What is claimed is:

1. A yarn support tube having a surface stringup groove extending partially around its circumference and located adjacent one of its ends for initiation of a helical transfer tail, said tube being also provided with a smooth-surfaced circumferential groove located between said one end and said stringup groove.

2. The yarn support tube as defined in claim 1, said circumferential groove being a smooth-surfaced indentation rolled into the surface of said tube.

* * * * *